US011047162B1

(12) United States Patent
Tennessee

(10) Patent No.: US 11,047,162 B1
(45) Date of Patent: Jun. 29, 2021

(54) TORSION SPRING DOOR CLOSING APPARATUS

(71) Applicant: Leonard Tennessee, Roswell, GA (US)

(72) Inventor: Leonard Tennessee, Roswell, GA (US)

( * ) Notice: Subject to any disclaimer, the term of this patent is extended or adjusted under 35 U.S.C. 154(b) by 0 days.

(21) Appl. No.: 16/807,531

(22) Filed: Mar. 3, 2020

(51) Int. Cl.
*E05F 1/08* (2006.01)
*E05F 1/12* (2006.01)
*E05F 3/20* (2006.01)

(52) U.S. Cl.
CPC ..... *E05F 1/1215* (2013.01); *E05F 3/20* (2013.01); *E05Y 2900/132* (2013.01)

(58) Field of Classification Search
CPC ..... Y10T 16/53828; Y10T 16/5388; Y10T 16/53888; Y10T 16/5389; Y10T 16/593; Y10T 16/599; Y10T 16/5995; Y10T 16/625; Y10T 16/2771; Y10T 16/283; Y10T 16/304; E05F 1/1215; E05F 1/1246; E05F 1/1016; E05F 3/20; E05Y 2900/132
See application file for complete search history.

(56) References Cited

U.S. PATENT DOCUMENTS 1,215,498 A * 2/1917 Dietz ..... E05F 1/1215 16/307
1,925,945 A * 9/1933 Zielinski ..... E05F 1/1016 16/76
2,037,411 A * 4/1936 Fay ..... E05F 1/1016 16/76
2,807,043 A * 9/1957 Gordon ..... E05F 1/1215 16/307
3,098,258 A 7/1963 Ruiz
3,329,991 A * 7/1967 Gobble ..... E05F 1/1083 16/50
3,712,287 A 1/1973 Summers, Jr.
3,825,973 A 7/1974 Gwozdz
4,485,522 A 12/1984 Chen
5,109,571 A 5/1992 Ohshima
5,191,678 A * 3/1993 Firari ..... E05F 5/02 16/305
5,320,333 A * 6/1994 Koch ..... B60S 1/3475 15/250.34
5,649,339 A * 7/1997 Reed ..... E05F 1/1215 16/50
5,855,040 A 1/1999 Lin
(Continued)

FOREIGN PATENT DOCUMENTS

GB 191321464 A * 2/1914 ..... E05F 1/1016
GB 324872 A * 2/1930 ..... E05F 1/1016
NL 1006598 C1 * 11/1997 ..... E05F 1/1215

*Primary Examiner* — Chuck Y Mah

(57) ABSTRACT

A torsion spring door closing apparatus for automatically closing doors with minimal hardware includes a torsion spring having a central coiled portion and a pair of arms. The coiled portion is configured to fit around a shaft of a hinge pin of a door hinge. The pair of arms comprises a hook arm and a catch arm each extending from the coiled portion. The pair of arms moves between a closed position and an open position and the torsion spring is biased towards the open position. When a door opens and squeezes the pair of arms towards the closed position they rebound to force the door to close again. A hook end of the hook is selectively engageable with a catch end of the catch arm to secure the torsion spring in the closed position and disengage the apparatus.

5 Claims, 5 Drawing Sheets

(56) References Cited

U.S. PATENT DOCUMENTS

| | | | | |
|---|---|---|---|---|
| 6,553,623 | B2 * | 4/2003 | Long | E05F 1/1215 16/285 |
| 7,520,022 | B2 * | 4/2009 | Conway | E05D 7/009 16/256 |
| 8,463,413 | B2 | 6/2013 | Oh | |
| 8,745,820 | B2 | 6/2014 | Janak | |
| 9,297,193 | B1 * | 3/2016 | Martin | E05F 1/1215 |
| D801,168 | S * | 10/2017 | Vavrinak | E05F 1/1016 D8/402 |
| 9,926,732 | B2 | 3/2018 | Bacchetti | |
| 2004/0068833 | A1 | 4/2004 | Sawa | |
| 2013/0081228 | A1 | 4/2013 | Janak | |

* cited by examiner

TORSION SPRING DOOR CLOSING APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to door closers and more particularly pertains to a new door closer for automatically closing doors with minimal hardware.

(2) Description of Related Art Including Information Disclosed Under 37 CFR 1.97 and 1.98

The prior art relates to door closers.

BRIEF SUMMARY OF THE INVENTION

An embodiment of the disclosure meets the needs presented above by generally comprising a torsion spring having a central coiled portion and a pair of arms. The coiled portion is configured to fit around a shaft of a hinge pin of a door hinge. The pair of arms comprises a hook arm and a catch arm each extending from the coiled portion. The pair of arms moves between a closed position and an open position and the torsion spring is biased towards the open position. A hook end of the hook is selectively engageable with a catch end of the catch arm to secure the torsion spring in the closed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
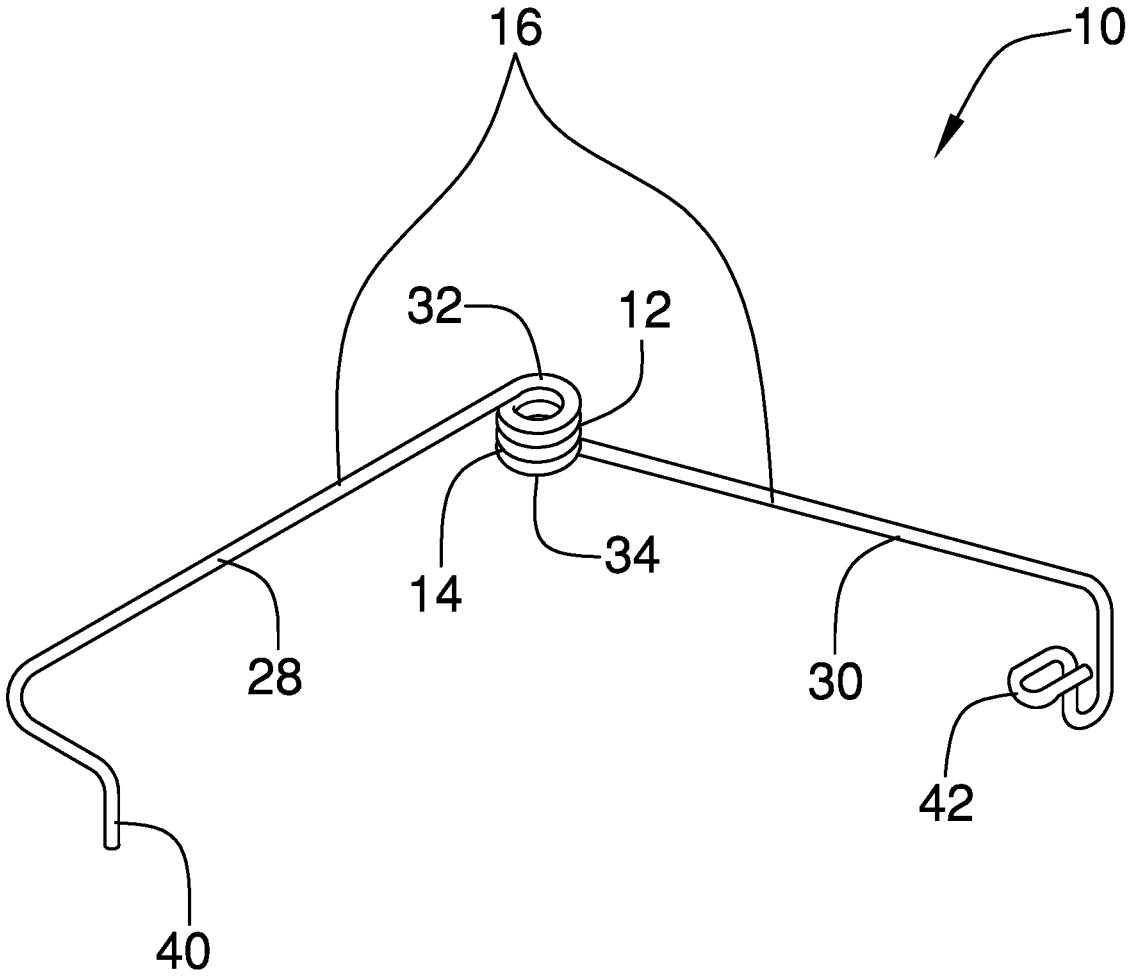
FIG. 1 is an isometric view of a torsion spring door closing apparatus according to an embodiment of the disclosure.
Figure 2:
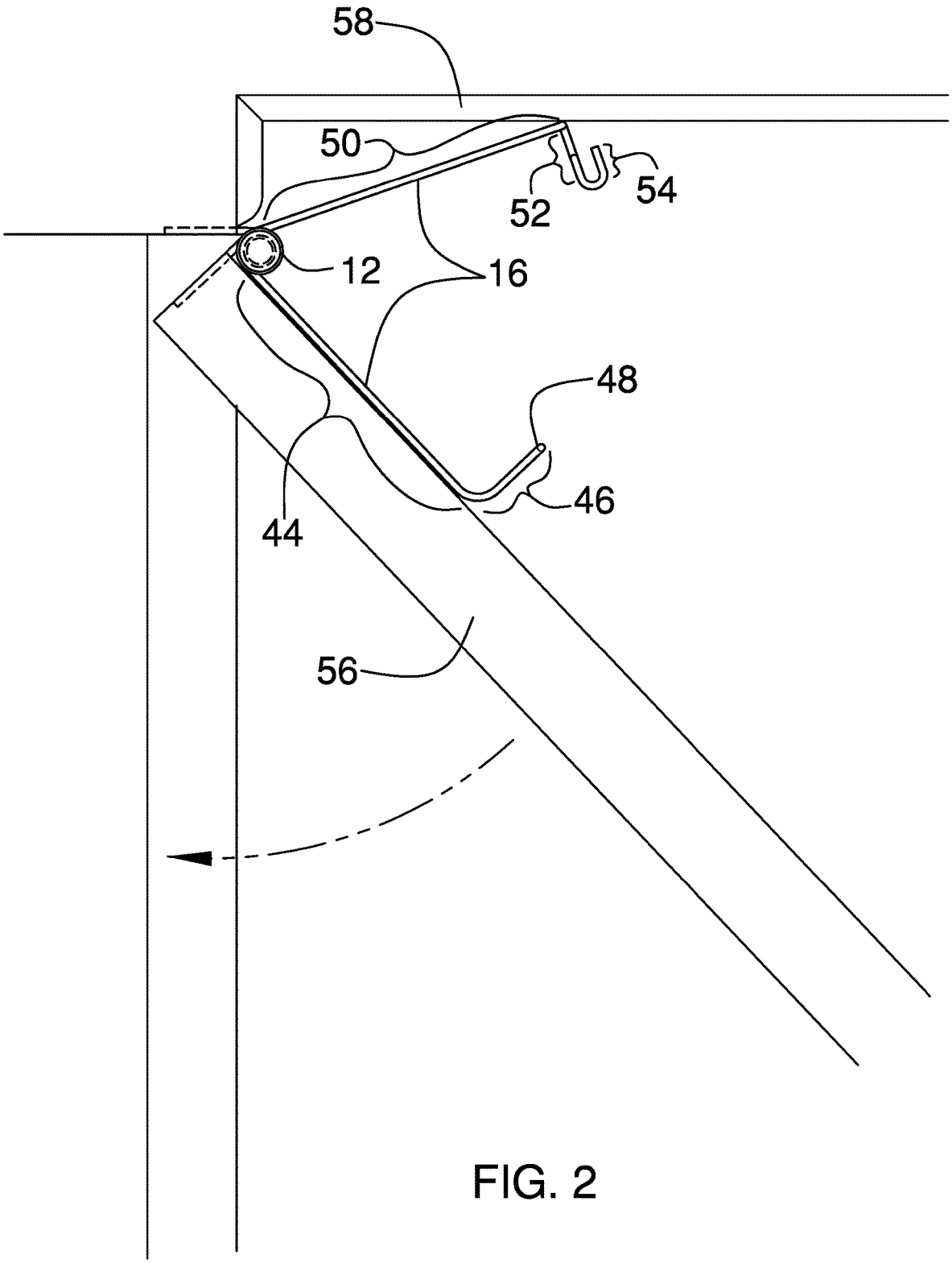
FIG. 2 is a top plan in-use view of an embodiment of the disclosure.
Figure 3:
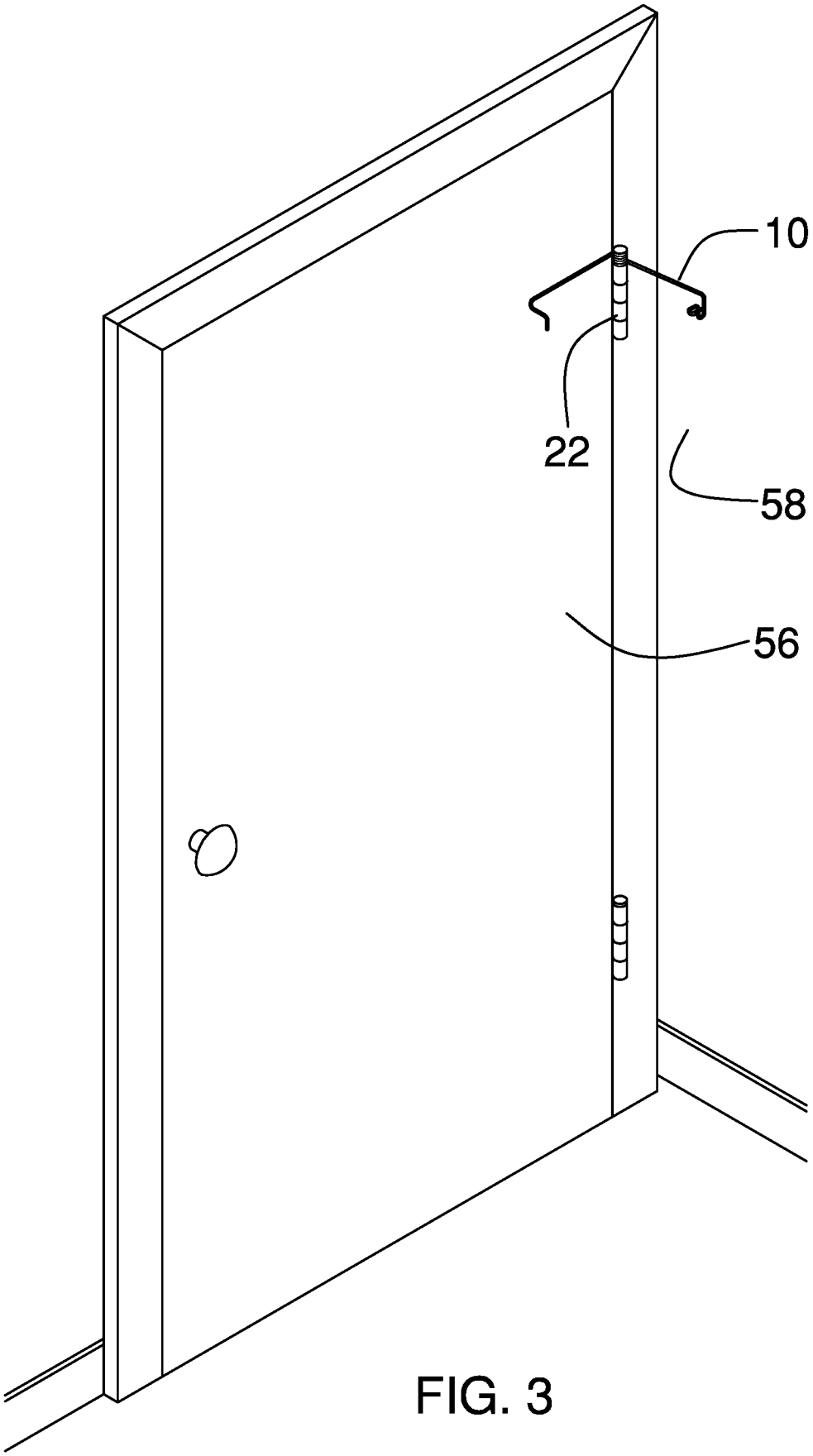
FIG. 3 is an in-use view of an embodiment of the disclosure.
Figure 4:
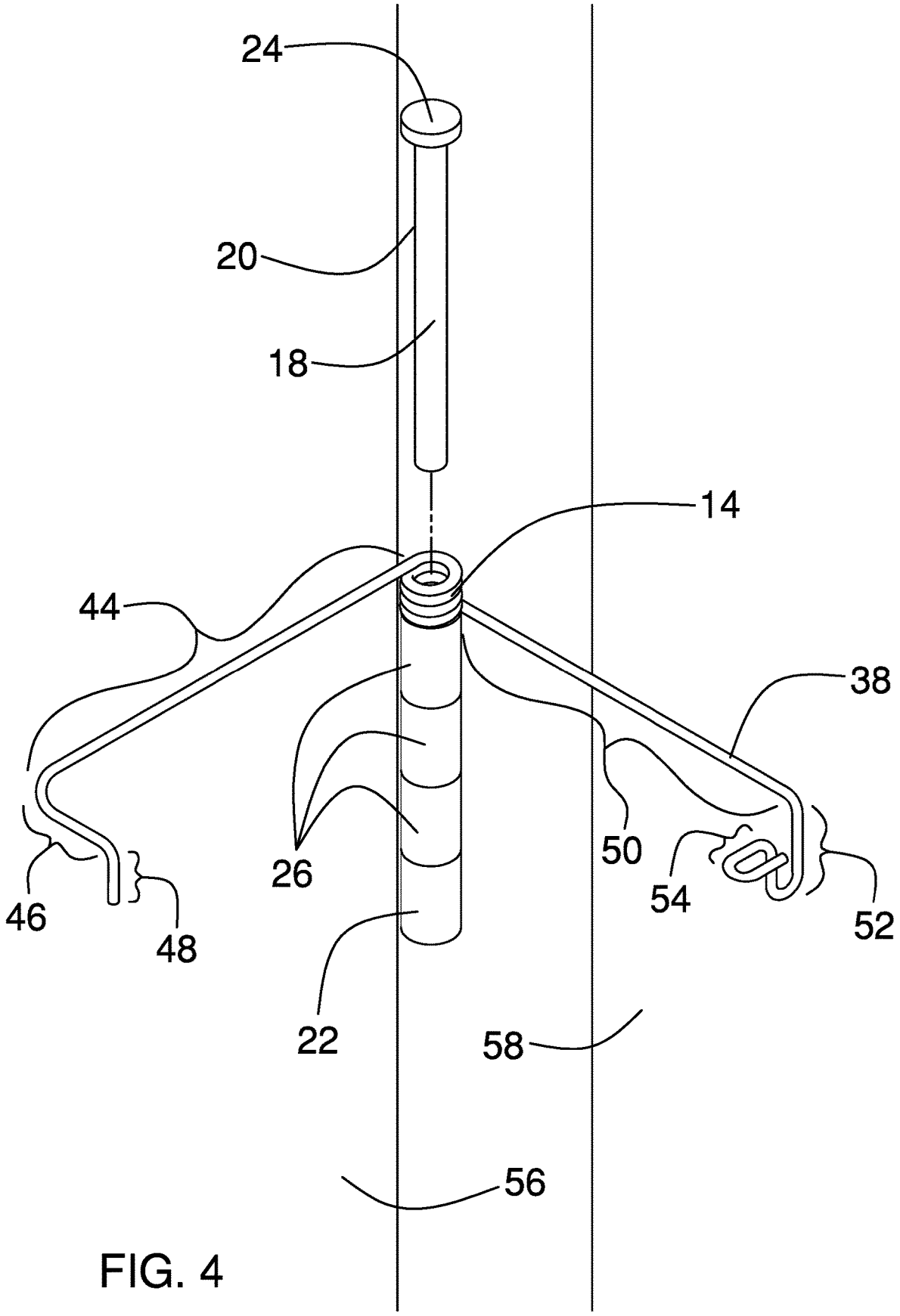
FIG. 4 is an isometric exploded in-use view of an embodiment of the disclosure.
Figure 5:
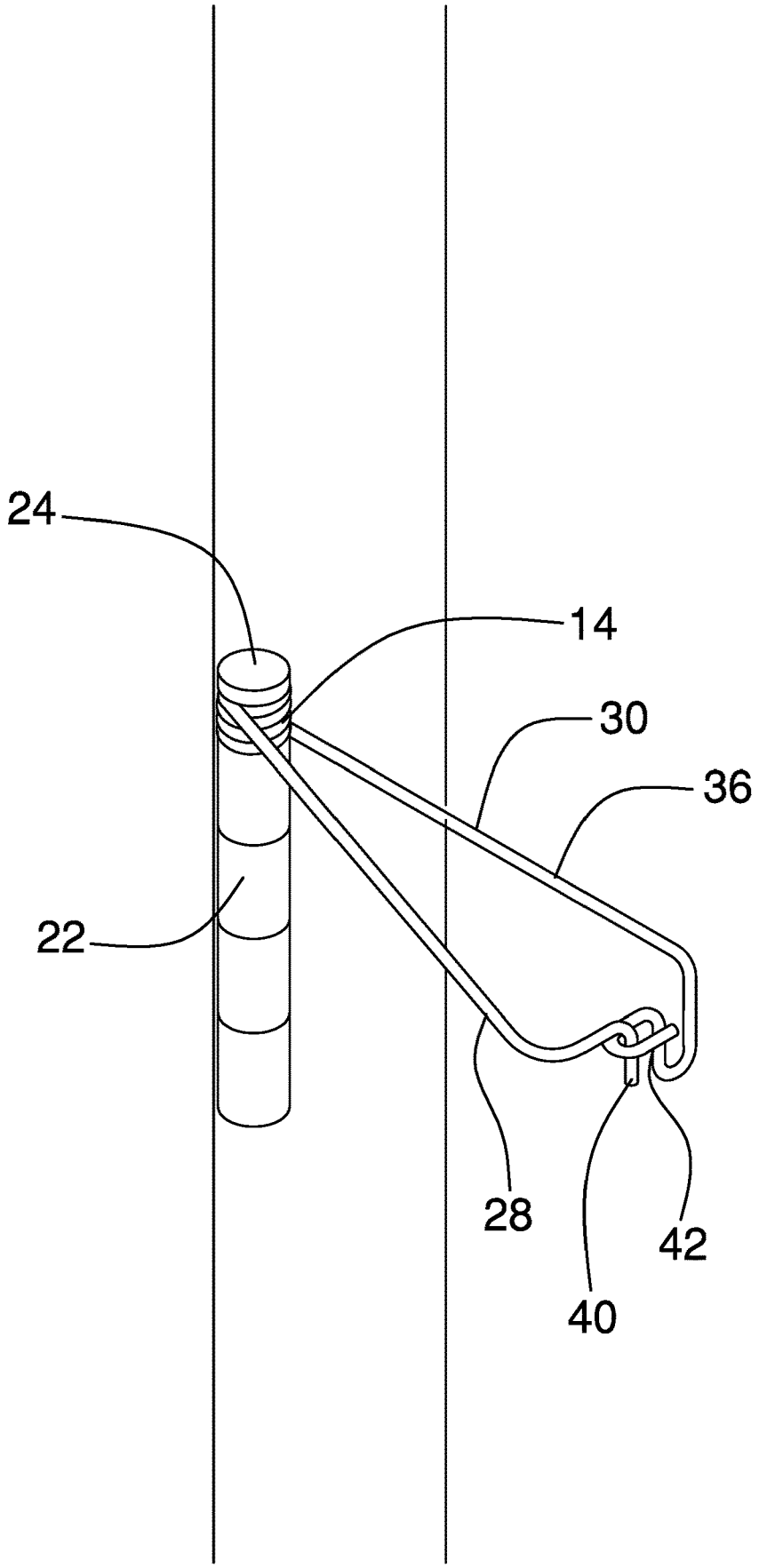
FIG. 5 is an isometric in-use view of an embodiment of the disclosure.

With reference now to the drawings, and in particular to FIGS. 1 through 5 thereof, a new door closer embodying the principles and concepts of an embodiment of the disclosure and generally designated by the reference numeral 10 will be described.

As best illustrated in FIGS. 1 through 5, the torsion spring door closing apparatus 10 generally comprises a torsion spring 12 having a central coiled portion 14 and a pair of arms 16. The coiled portion 14 is configured to fit around a shaft 18 of a hinge pin 20 of a door hinge 22. The torsion spring 12 is secured between a head 24 of the hinge pin and a plurality of knuckles 26 of the door hinge. The pair of arms 16 comprises a hook arm 28 and a catch arm 30 each extending from the coiled portion 14. The hook arm 28 may extend from a top side 32 of the coiled portion and the catch arm 30 may extend from a bottom side 34 of the coiled portion. The pair of arms 16 moves between a closed position 36 and an open position 38. The hook arm 28 and the catch arm 30 may be perpendicular in the open position 38 and the torsion spring 12 is biased towards the open position 38.

A hook end 40 of the hook arm is selectively engageable with a catch end 42 of the catch arm to secure the torsion spring 12 in the closed position 36. The hook arm 28 has a first main portion 44 extending from the coiled portion 14, an extension portion 46 extending perpendicularly from the first main portion 44 and parallel to the catch arm 30, and a drop portion 48 extending down perpendicularly from the extension portion 46. A length of the extension portion 46 may be greater than a length of the drop portion 48. The catch arm 30 has a second main portion 50 extending from the coiled portion 14, a vertical U-shaped portion 52 extending down and perpendicular to the second main portion 50, and a horizontal U-shaped portion 54 extending from the vertical U-shaped portion 52. The horizontal U-shaped portion 54 lies coplanar to the second main portion 50. The drop portion 48 of the hook arm is selectively engageable within the horizontal U-shaped portion 54 of the catch arm.

In use, the apparatus 10 is installed on the door hinge 22 of a door 56. When the door 56 opens the pair of arms 16 is squeezed between the door 56 and a wall 58 towards the closed position 36. The torsion spring 12 rebounds to spread the pair of arms 16 back to the open position 38 and forces the door 56 to close again. To disengage the apparatus 10, the drop portion 48 of the hook arm is engaged within the horizontal U-shaped portion 54 of the catch arm.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A torsion spring door closing apparatus comprising:

a torsion spring, the torsion spring having a central coiled portion and a pair of arms, the coiled portion being configured to fit around a shaft of a hinge pin of a door hinge, the pair of arms comprising a hook arm and a catch arm each extending from the coiled portion, the pair of arms moving between a closed position and an open position, the torsion spring being biased towards the open position; and a hook end of the hook arm being selectively engageable with a catch end of the catch arm to secure the torsion spring in the closed position, the hook arm having a first main portion extending from the coiled portion, an extension portion extending perpendicularly from the first main portion and parallel to the catch arm, and a drop portion extending down perpendicularly from the extension portion, the catch arm having a second main portion extending from the coiled portion, a vertical U-shaped portion extending down and perpendicular to the second main portion, and a horizontal U-shaped portion extending from the vertical U-shaped portion, the horizontal U-shaped portion lying coplanar to the second main portion, the drop portion of the hook arm being selectively engageable within the horizontal U-shaped portion of the catch arm.

2. The torsion spring door closing apparatus of claim 1 further comprising the hook arm and the catch arm being perpendicular in the open position.

3. The torsion spring door closing apparatus of claim 1 further comprising a length of the extension portion being greater than a length of the drop portion.

4. A torsion spring door closing apparatus comprising:

a torsion spring, the torsion spring having a central coiled portion and a pair of arms, the coiled portion being configured to fit around a shaft of a hinge pin of a door hinge, the pair of arms comprising a hook arm and a catch arm each extending from the coiled portion, the pair of arms moving between a closed position and an open position, the hook arm and the catch arm being perpendicular in the open position, the torsion spring being biased towards the open position; and a hook end of the hook arm being selectively engageable with a catch end of the catch arm to secure the torsion spring in the closed position, the hook arm having a first main portion extending from the coiled portion, an extension portion extending perpendicularly from the first main portion and parallel to the catch arm, and a drop portion extending down perpendicularly from the extension portion, a length of the extension portion being greater than a length of the drop portion, the catch arm having a second main portion extending from the coiled portion, a vertical U-shaped portion extending down and perpendicular to the second main portion, and a horizontal U-shaped portion extending from the vertical U-shaped portion, the horizontal U-shaped portion lying coplanar to the second main portion, the drop portion of the hook arm being selectively engageable within the horizontal U-shaped portion of the catch arm.

5. A door hinge and torsion spring door closing apparatus combination comprising:

a door hinge, the door hinge having a hinge pin and a plurality of knuckles;

a torsion spring, the torsion spring having a central coiled portion and a pair of arms, the coiled portion being coupled around a shaft of the hinge pin of the door hinge, the pair of arms comprising a hook arm and a catch arm each extending from the coiled portion, the pair of arms moving between a closed position and an open position, the hook arm and the catch arm being perpendicular in the open position, the torsion spring being biased towards the open position; and a hook end of the hook arm being selectively engageable with a catch end of the catch arm to secure the torsion spring in the closed position, the hook arm having a first main portion extending from the coiled portion, an extension portion extending perpendicularly from the first main portion and parallel to the catch arm, and a drop portion extending down perpendicularly from the extension portion, a length of the extension portion being greater than a length of the drop portion, the catch arm having a second main portion extending from the coiled portion, a vertical U-shaped portion extending down and perpendicular to the second main portion, and a horizontal U-shaped portion extending from the vertical U-shaped portion, the horizontal U-shaped portion lying coplanar to the second main portion, the drop portion of the hook arm being selectively engageable within the horizontal U-shaped portion of the catch arm.

* * * * *